US006387869B2

(12) United States Patent
Bauer et al.

(10) Patent No.: US 6,387,869 B2
(45) Date of Patent: May 14, 2002

(54) GRANULAR SURFACTANT COMPOSITION OF IMPROVED FLOWABILITY COMPROMISING SODIUM SILICATE AND LINEAR ALKYLBENZENESULFONATES

(75) Inventors: Harald Bauer, Kerpen; Josef Holz; Gunther Schimmel, both of Erfstadt, all of (DE)

(73) Assignee: Clariant GmbH, Frankfurt (DE)

( * ) Notice: Subject to any disclaimer, the term of this patent is extended or adjusted under 35 U.S.C. 154(b) by 0 days.

(21) Appl. No.: 09/822,977

(22) Filed: Mar. 30, 2001

Related U.S. Application Data

(63) Continuation-in-part of application No. 09/346,426, filed on Jul. 1, 1999, now abandoned.

(30) Foreign Application Priority Data

Jul. 8, 1998 (DE) ..... 198 30 590
Jun. 8, 1999 (DE) ..... 199 25 930

(51) Int. Cl.[7] ..... C11D 13/10; C11D 1/22; C11D 7/14

(52) U.S. Cl. ..... 510/444; 510/276; 510/290; 510/443; 510/452; 510/507; 510/511; 510/531; 510/532; 510/536

(58) Field of Search ..... 510/276, 290, 510/443, 452, 444, 507, 311, 531, 532, 536

(56) References Cited

U.S. PATENT DOCUMENTS 4,664,839 A 5/1987 Rieck ..... 252/175
4,820,439 A 4/1989 Rieck ..... 252/135
5,108,646 A * 4/1992 Beerse et al. ..... 252/174.25
5,356,607 A * 10/1994 Just ..... 423/334
5,431,857 A * 7/1995 Capeci ..... 252/549
5,540,855 A * 7/1996 Baillely et al. ..... 510/276
5,614,161 A * 3/1997 Wilkens et al. ..... 423/332
5,773,401 A * 6/1998 Murata et al. ..... 510/361
5,807,529 A * 9/1998 Kruse et al. ..... 423/332
5,821,207 A * 10/1998 Kanai et al. ..... 510/531
5,837,666 A * 11/1998 Murata et al. ..... 510/299
5,858,299 A * 1/1999 Fernholz et al. ..... 264/414

FOREIGN PATENT DOCUMENTS

WO WO 91/08171 6/1991
WO WO 92/18594 10/1992
WO WO 95/29978 9/1995

OTHER PUBLICATIONS

*Zur Fliessfähigkeit von Schüttgütern—Definition und Messverfahren* by Dietmar Schulze, Chem.–Ing.–Tec.67 (1995) Nr. 1. S. 60–68.

* cited by examiner

*Primary Examiner*—Charles Boyer
(74) *Attorney, Agent, or Firm*—Susan S. Jackson; Scott E. Hanf

(57) ABSTRACT

A granular surfactant composition comprising sodium silicate and linear alkylbenzenesulfonates, wherein the granular surfactant composition has a mean particle diameter of ≧50 μm and an $ff_c$ value of ≧7; a process for the preparation of this granular surfactant composition, its use, and detergents and cleaners which comprise such granular surfactant composition and a process for the making of the same; and, where appropriate, the granular surfactant composition comprises other active ingredients and auxiliaries.

11 Claims, No Drawings

GRANULAR SURFACTANT COMPOSITION OF IMPROVED FLOWABILITY COMPROMISING SODIUM SILICATE AND LINEAR ALKYLBENZENESULFONATES

CROSS-REFERENCE TO RELATED APPLICATION

This application is a continuation-in-part of U.S. application Ser. No. 09/346,426, filed Jul. 1, 1999, now abandoned.

FIELD OF THE INVENTION

The invention relates to a granular surfactant composition comprising sodium silicate and other constituents, to a process for its preparation and to its use.

BACKGROUND OF THE INVENTION

Crystalline layered sodium silicates (phyllosilicates), in particular those of the formula $NaMSi_xO_{2x}+1.yH_2O$, where M is sodium or hydrogen, x is a number from 1.9 to 4, and y is a number from 0 to 20, and preferred values for x are 2, 3 or 4, have proven to be suitable replacements for the builders phosphate and zeolite, especially in detergents and cleaners.

The use of the abovementioned crystalline phyllosilicates for softening water is described, for example, in EP-A-0 164 514. Preferred crystalline phyllosilicates are those in which M is sodium and x assumes the values 2 or 3.

Preferred materials are either beta- or delta-sodium disilicates ($Na_2Si_2O_5.yH_2O$), it being possible to obtain beta-sodium disilicate, for example, by the process in PCT/WO 91/08171.

A commercially available crystalline sodium disilicate which corresponds to the abovementioned formula is, for example, SKS-6 from Clariant GmbH. This product is composed of the various polymorphous phases of sodium disilicate and thus consists of alpha-disodium disilicate, beta-disodium disilicate and delta-disodium disilicate. Preference is given to as high as possible a content of delta-disodium disilicate. The commercial product may also comprise components of noncrystallized sodium silicate.

The above mentioned sodium disilicates are normally used together with surfactants in the many diverse fields. These surfactants also include the known anionic linear alkylbenzenesulfonates (also referred to as LAS).

In detergent production, the abovementioned known anionic linear alkylbenzenesulfonates (LAS) in liquid water-containing form, together with other detergent ingredients such as soda, water glass etc., are generally converted into a dry pulverulent form in a spray drying process. The material normally has a low bulk density since the spray droplets expand in the spray tower as a result of the evaporation of water to form hollow spheres/beads. This product form makes the preparation of compact detergents difficult, and the resulting powder lacks good flowability, which hinders transportation during the detergent production process.

The spray-drying process is, moreover, energy-intensive since all of the components must be dissolved in water to give an aqueous slurry, and this water must be evaporated in the spray tower, which is energy-intensive. The required bulk density can in most cases only be achieved by means of a further additional agglomeration step.

SUMMARY OF THE INVENTION

The object of the invention is now to provide surfactant compositions which have high flowability. It is likewise the object of the invention to convert linear alkylbenzenesulfonates from the liquid form into a solid, granular, readily flowable form.

This object is achieved by a granular surfactant composition comprising sodium silicate and other constituents of the type mentioned at the outset, which comprises from 20 to 95% by weight of sodium silicate and from 5 to 80% by weight of at least one linear alkylbenzenesulfonate, and has a mean particle diameter of $\geqq 50\ \mu m$ and an $ff_c$ value of $\geqq 7$.

DESCRIPTION OF THE PREFERRED EMBODIMENTS

Preferably, the granular surfactant composition according to the invention has a mean particle diameter of $\geqq 150\ \mu m$.

Particularly preferably, the granular surfactant composition according to the invention has a mean particle diameter of $\geqq 300\ \mu m$.

Preferably, the granular surfactant composition according to the invention comprises from 60 to 80% by weight of sodium silicate and from 20 to 40% by weight of at least one linear alkylbenzenesulfonate.

Preferably, the granular surfactant composition according to the invention has an $ff_c$ value of $\geqq 10$.

The above object is likewise achieved by a process of preparation of a granular surfactant composition comprising sodium silicate and other constituents, which comprises mixing a finely divided crystalline sodium disilicate having a particle diameter $d_{90}$ of $\leqq 150\ \mu m$ with at least one linear alkylbenzenesulfonate.

Preferably, the finely divided crystalline sodium disilicate has a particle diameter $d_{90}$ of $\leqq 100\ \mu m$.

Particularly preferably, the finely divided crystalline sodium disilicate has a particle diameter $d_{90}$ of $\leqq 50\ \mu m$.

The invention also relates to the use of the granular surfactant compositions according to invention for the production of detergents and cleaners, including dishwashing detergents.

The invention likewise relates to detergents and cleaners which comprise a granular surfactant composition according to the invention, in particular in addition to other ingredients, active ingredients and auxiliaries. The amounts given below are, where appropriate, even if this is not expressly mentioned, made up to total 100% by weight by the customary ingredients, active ingredients and auxiliaries for detergents and cleaners.

Preferably, such detergents and cleaners comprise from 1 to 80% by weight of the granular surfactant composition according to the invention.

Preferably, such detergents and cleaners comprise from 1 to 80% by weight of zeolite and from 1 to 80% by weight of the granular surfactant composition according to the invention.

Preferably, such detergents and cleaners comprise from 1 to 80% by weight of zeolite, from 1 to 80% by weight of crystalline sodium phyllosilicate and from 1 to 80% by weight of the granular surfactant composition according to the invention.

The abovementioned process can process either commercial crystalline sodium disilicate SKS-6 or the finely divided crystalline sodium disilicate used, in suitable mixers with LAS solution, to give a surfactant composition.

Suitable mixers may be: Lödige ploughshare mixers, L ödige annular gap mixers (e.g. model CB30), Schugi Flexomix mixers, Niro HEC annular gap mixer, annular bed mixers (e.g. model K-TTE4) from Drais/Mannheim, Eirich mixers (e.g. model R02), Telschig mixers (model WPA6), zig-zag mixers from Niro.

Mixers that are not suitable for use in the present invention are high energy mixers or energy intensive mixers that impart, for example, from about $1\times10^{11}$ to about $2\times10^{12}$ erg/kg of energy to said mixture at a rate of from about $1\times10^{9}$ to about $3\times10^{9}$ erg/kg·s.

The water-containing product mixture which initially forms is dried in a suitable dryer. Dryers which can be used for the purposes of the invention are: fluidized-bed dryers from Hosokawa Schugi (models: Shugi fluid-bed, Vometec fluidized-bed dryer), fluidized-bed dryers from Waldner or from Glatt, turbo flotation dryers from Waldner, spin-flash dryers from Anhydro and rotary dryers.

Preferably, the dryer should aid agglomeration to give a granular material as a result of suitable agitation of the material. To carry out agglomeration in this stage leads to more uniform products than continued mixing in the mixer. Agglomeration is also obtained there, although the grain size is less uniform and agglutination and clumping occurs to a high degree.

Preferred operating conditions in the fluidized-bed dryer are: incoming air temperature 120–180° C., product temperature about 60° C.

As described above, it has now surprisingly been found that the abovementioned surfactant compositions differ widely in their flowability depending on the type of silicate used.

Assuming an identical content of linear alkylbenzenesulfonate in the surfactant composition, granular surfactant compositions according to the invention, prepared from finely divided sodium disilicate having a $d_{90}$ value below 150 $\mu$m, preferably below 100 $\mu$m, and particularly preferably below 50 $\mu$m, surprisingly exhibit very much better flowabilities than surfactant compositions containing a more coarse silicate starting material. Such surfactant compositions comprising finely divided crystalline sodium disilicate and linear alkylbenzenesulfonate are thus significantly more advantageous for the detergent production process than surfactant compositions which are prepared with coarsely divided sodium disilicate.

If, on the other hand, a certain flow behavior is prescribed, then, using finely divided crystalline sodium disilicate a significantly larger amount of linear alkylbenzenesulfonate can be converted into the granular, readily flowable form than when using coarsely divided crystalline sodium disilicate.

The surfactant compositions according to the invention can be used in the wide range of powder detergents which are common nowadays. Preferably, the phyllosilicate component and, particularly preferably, the LAS component are introduced into the formulation via the surfactant compositions according to the invention.

Examples 6 to 9 show that the surfactant compositions according to the invention (prepared with finely divided crystalline sodium silicate) can be used advantageously in detergent formulation and are equivalent, in terms of the main characteristic which is important for detergent builders of "inorganic incrustations", to surfactant compositions comprising coarsely divided crystalline sodium silicate.

The essential advantage of surfactant compositions comprising finely divided crystalline sodium silicate is the better flowability of the resulting surfactant composition and the possibility of dispensing with energy-intensive and costly spray-tower technology.

The properties of the granular surfactant compositions according to the invention were determined using the following measurement methods.

Determination of the Particle Size Distribution by Sieve Analysis

In a sieve machine from Retsch, the inserts with the desired sieves are used. The mesh size of the sieve decreases from top to bottom. 50 g of the powder to be investigated are placed onto the coarsest sieve. By vibrating the sieve machine, the powder material is conveyed through the various sieves. The residues on the sieves are weighed and related mathematically to the initial weight of material. The values can be used to calculate the $d_{50}$ and $d_{90}$ values.

Flowability

The ability of powders, when allowed to move freely, to be flowable is referred to by the person skilled in the art as flowability. This is a very important characteristic since it is a measure of how easy it is to handle, i.e. transport, the material, store it in containers and, especially, remove it again from the containers. For the production of modem detergents in pulverulent or granular form, the raw materials must themselves have a number of advantageous properties. Both the detergent itself (corresponding to the sum of all ingredients) and also the production intermediates must have sufficiently high flowability in order to ensure easy handling during detergent production and on the route to, and after receipt by, the consumer. Easy handling is taken to mean, for example, simple transportation of the material during production (flowability), the suppression of clumping and caking during production and finally also in final packaging.

The flowability of bulk materials can be characterized using the $ff_c$ value. The flow properties are measured in an annular shearing device. For this, a material sample is compacted in the cylindrical annular measuring chamber under the action of a stress and simultaneous rotation of the floor of the chamber relative to the roof of the chamber. To improve power transmission, baffles are attached to the floor and the roof of the chamber. The stress at which the material is just sheared by the torsional movement is then determined. This is described by D. Schulze in Chem.-Ing.-Techn. 67 (1995) 60–68 The $ff_c$ value is th e quotient calculated when the compacting stress $sigma_1$; is divided by the strength of the bulk material $sigma_c$.

Accordingly, $ff_c$ values of from 2 to 4 indicate cohesive bulk material, values of from 4 to 10 indicate moderately flowing products and values above 10 indicate free-flowing products.

Preparation of Compositions Comprising Finely Divided Crystalline Sodium Disilicate and Linear Alkylbenzenesulfonate (LAS)

1750 g of SKS-6 powder are introduced into a Lödige mixer, model M 20MK. 1000 g of Marlon A 375 (Hüls) are added dropwise continuously as linear alkylbenzenesulfonate, with continuous mixing. The mixture is then fixed for ½ min. The product is dried in a Retsch laboratory dryer for 25 min. at 100° C. incoming air temperature, then sieved (as granules), through a sieve of mesh size 1180 $\mu$m, and the small oversize component is discarded.

Production of the Test Detergents

The optical brighteners are stirred into a quarter of the amount of nonionic and mixed with half of the amount of soda in a domestic multimixer (Braun). In a Lödige ploughshare mixer, the remaining soda and all of the zeolite and Polymer 15 are mixed at 300 rpm. Half of the remaining nonionic is then sprayed on over 5 minutes. The SKS-6 is then added, and the mixture is mixed for 10 minutes. The remaining second half of nonionic is then sprayed on over a further 5 minutes. Finally, anionic, soap, antifoam, phosphonate and optical brightener are added, and the mixture is stirred for 10 minutes at 300 rpm. In a fumble mixer, perborate, TAED and enzymes are added to the mixture from the Lödige mixer with low shear force and the mixture is mixed for 15 minutes.

It is, of course, also possible to change the order in which the substances are added.

Washing Tests

In a standard domestic washing machine (model: Novotronic 927 WPS, Meile) specific test fabrics are washed repeatedly (15 times) at 60° C. and a water hardness of 18° German hardness using this test detergent in an amount of 65 g /wash cycle. The test fabrics, which are, in particular, a cotton terry fabric (Vossen), and, respectively, a cotton double rib fabric, polyester/cotton blend fabric (type 20A) and standard cotton fabric (type 10A) from W äschereiforschung Krefeld Testgewebe GmbH and a standard cotton fabric from the Swiss Materials Testing Institute, St. Gallen, Switzerland, are supplemented with further laundry ballast (3.75 kg). After 15 washes, a sample is taken from each of the fabrics and ashed in a muffle oven at a temperature of 1000° C. for a period of 24 hours.

EXAMPLE 1 (COMPARISON)

10 kg of commercially available SKS-6 (Clariant GmbH, Frankfurt) are placed in portions onto an electric vibrating sieve (model TMA 3070 from Siemens) having a metal sieve of mesh size 1000 μm. The starting material has the following particle size distribution according to this sieve analysis:

>1000 μm: 5.5%
>500 μm: 19.8%
>300 μm: 27.9%
>150 μm: 42.2%
>75 μm: 63.2%
$d_{50}$=122 μm
$d_{90}$=843 μm

The undersize material obtained was about 9 kg of SKS-6 powder having the following particle size distribution (sieve analysis):

>1000 μm: 0.2%
>850 μm: 0.4%
>710 μm: 2.15%
>500 μm: 6.9%
>300 μm: 13.7%
>150 μm: 26.9%
$d_{50}$=68 μm
$d_{90}$=321 μm

The sieve residue test gave 91.3% of residue.

Following the general procedure "Preparation of compounds from finely divided crystalline sodium disilicate", this coarsely divided product was processed with Marlon A 375 to give a surfactant composition. The starting material had an $ff_c$ value of 10.0, the surfactant composition a value of 6.1. The surfactant composition is thus less flowable than the starting material. The other analytical data are given in Table 1.

EXAMPLE 2 (COMPARISON)

SKS-6 powder was sieved as in Example 1. The starting material had the following phase distribution: alpha-disodium disilicate 5.6%, beta-disodium disilicate 2.3%, delta-disodium disilicate 90.4%, amorphous component 1.4% (% by weight).

It had the following particle size distribution according to sieve analysis:

>1000 μm: 3.4%
>500 μm: 17.5%
>300 μm: 26.6%
>150 μm: 44.6%
>75 μm: 65.9%
$d_{50}$=131 μm
$d_{90}$=766 μm

The undersize material obtained was about 8 kg of SKS-6 powder having the following particle size distribution (sieve analysis):

>500 μm: 0.1%
>300 μm: 9.1%
>150 μm: 29.8%
>100 μm: 51.7%
$d_{50}$=81 μm
$d_{90}$=245 μm

The sieve residue test gave 86.9% of residue.

Following the general procedure "Preparation of compounds from finely divided crystalline sodium disilicate", this coarsely divided product was processed with Marlon A 375 to give a surfactant composition. The surfactant composition had an $ff_c$ value of 5.6. The other analytical data are given in Table 1.

EXAMPLE 3 (COMPARISON)

SKS-6 powder was sieved as in Example 1. The starting material had the following phase distribution: alpha-disodium disilicate 10.8%, beta-disodium disilicate 4.4%, delta-disodium disilicate 79.4%, amorphous component 5.4%.

It had the following particle size distribution according to sieve analysis:

>1000 μm: 4.4%
>500 μm: 18.3%
>300 μm: 26.9%
>150 μm: 43.6%
>75 μm: 64.4%
$d_{50}$=127 μm
$d_{90}$=799 μm

The oversize material was ground in a ball mill for 3 h using a U 280A0 ball mill from Welte which is lined on the inside with metal and whose drum rotates at about 50 rpm. The grinding media used are 44 kg of porcelain balls with diameters of 1.8, 2.9, 3.5 and 5 cm. Sieving was then carried out again. The undersize fractions, a total of 9 kg, were combined and had the following particle size distribution (sieve analysis):

>150 μm: 13.8%
>75 μm: 44.3%
>63 μm: 54.3%
>53 μm: 67.1%
$d_{50}$=72 μm
$d_{90}$=157 μm

The sieve residue test gave 73.5% of residue.

Following the general procedure "Preparation of compounds from finely divided crystalline sodium disilicate", this coarsely divided product was processed with Marlon A 375 to give a surfactant composition. The surfactant composition had an $ff_c$ value of 6.8. The other analytical data are given in Table 1.

EXAMPLE 4 (INVENTION)

10 kg of SKS-6 powder were ground as in Example 3. This had the following particle size distribution according to sieve analysis:

>1000 μm: 3.9%
>500 μm: 19.5%
>300 μm: 28.8%
>150 μm: 47.1%
>75 μm: 68.6%
$d_{50}$=140 μm
$d_{90}$=805 μm

The resulting ground product (about 10 kg) has the following particle size distribution (Microtrac):

>53 μm 0.5%
>33 μm: 10%
>20 μm: 30.6%
$d_{50}$=11.9 μm
$d_{90}$=33.9 μm

The ground product had the following phase distribution: alpha-disodium disilicate 22.0%, beta-disodium disilicate 12.1%, delta-disodium disilicate 65.3% amorphous component 0.6%. The sieve residue test gave 20.3% of residue.

Following the general procedure "Preparation of compounds from finely divided crystalline sodium disilicate", this finely divided product was processed with Marlon A 375 to give a surfactant composition. The starting material had an $ff_c$ of 5.6, and the surfactant composition had a value of 10.0. The surfactant composition is thus more flowable than the starting material. The other analytical data are given in Table 1.

EXAMPLE 5 (INVENTION)

SKS-6 powder was ground in an Aeroplex fluidized-bed counter-jet mill from Hosokawa-Alpine AG (Model AFG-200) at a material feed of 6–10 kg/h and a classifier disk rotation rate of 6000 rpm. It had the following particle size distribution according to sieve analysis:

>1000 μm: 5.8%
>500 μm: 20.0%
>300 μm: 28.3%
>150 μm: 45.5%
>75 μm: 68.6%
$d_{50}$=135 μm
$d_{90}$=852 μm

The resulting ground product (about 600 kg) gave the following particle size distribution (Microtrac):

$d_{50}$=5.5 μm
$d_{90}$=12 μm

The ground product had the following phase distribution: alpha-disodium disilicate 10.6%, beta-disodium disilicate 6.9%, delta-disodium disilicate 80.3% amorphous component 2.3%. The sieve residue test gave 21.1% of residue.

Following the general procedure "Preparation of compounds from finely divided crystalline sodium disilicate", this finely divided product was processed with Marlon A 375 to give a surfactant composition. The surfactant composition had an $ff_c$ value of 12.3. The other analytical data are given in Table 1.

TABLE 1

Characteristics of the surfactant compositions

| | Ex. 1 | Ex. 2 | Ex. 3 | Ex. 4 | Ex. 5 |
|---|---|---|---|---|---|
| Content of silicate | 66.7 | 66.4 | 66.5 | 65.9 | 62.7 |
| Content of LAS | 32.9 | 33.3 | 32.6 | 33.7 | 36.5 |
| Loss on drying [%] | 0.40 | 0.29 | 0.88 | 0.41 | 0.83 |
| Loss on ignition [%] | 27.37 | 27.56 | 27.60 | 28.04 | 30.75 |
| Proportion of particles >1180 μm [%] | 0.71 | 0.35 | 0.21 | 0.68 | 0.00 |

TABLE 1-continued

Characteristics of the surfactant compositions

| | Ex. 1 | Ex. 2 | Ex. 3 | Ex. 4 | Ex. 5 |
|---|---|---|---|---|---|
| Proportion of particles >1000 μm [%] | 8.62 | 2.40 | 3.39 | 12.38 | 0.74 |
| Proportion of particles >710 μm [%] | 45.84 | 18.04 | 23.69 | 39.14 | 12.30 |
| Proportion of particles >425 μm [%] | 88.02 | 66.15 | 74.19 | 68.39 | 42.90 |
| Proportion of particles >212 μm [%] | 99.25 | 98.19 | 99.12 | 96.16 | 80.28 |
| Proportion of particles >150 μm [%] | 99.85 | 99.79 | 99.69 | 99.19 | 85.97 |
| Proportion of particles >150 μm [%] | 0.15 | 0.21 | 0.31 | 0.81 | 14.03 |
| d50 value [μm] | 681.9 | 520.7 | 561.5 | 604.2 | 384.5 |
| Flowability [ffc] | 6.1 | 5.6 | 6.8 | 10.0 | 12.3 |
| Flowability of the Starting material [ffc] | 10.0 | — | — | 5.6 | — |

LAS = linear alkylbenzenesulfonate

EXAMPLE 6 (INVENTION)

Following the general procedure "Preparation of the test detergents" a test compact heavy-duty detergent comprising 27.4% by weight of surfactant composition from Example 5 and 13.8% by weight of commercially available SKS-6 powder (this corresponds to 31% by weight of silicate and 10% by weight of linear alkylbenzenesulfonate) was prepared. In model washing tests following the general procedure "Washing tests", the formation of inorganic incrustations was investigated. The mean value of the ash values for all five fabrics is 1.7%.

EXAMPLE 7 (INVENTION)

Following the general procedure "Preparation of the test detergents", a test compact color detergent comprising 20.8% by weight of surfactant composition from Example 4 and 21.3% by weight of commercially available SKS-6 powder (this corresponds to 35% by weight of silicate and 7% by weight of linear alkylbenzenesulfonate) was prepared. In model washing tests following the general procedure "Washing tests", the formation of inorganic incrustations was investigated. The mean value of the ash values for all five fabrics is 1.9%.

EXAMPLE 8 (INVENTION)

Following the general procedure "Preparation of the test detergents", a test compact heavy-duty detergent comprising 27.4% by weight of surfactant composition from Example 5 and 3.1% by weight of commercially available SKS-6 powder was prepared (this corresponds to 20.3% by weights of silicate and 10% by weight of linear alkylbenzenesulfonate). In model washing tests following the general procedure "Washing tests", the formation of inorganic incrustations was investigated. The mean value of the ash values for all five fabrics is 1.9%.

EXAMPLE 9 (INVENTION)

Following the general procedure "Preparation of the test detergents", a test compact heavy-duty detergent comprising 30.4% by weight of surfactant composition from Example 1 was prepared (this corresponds to 20.3% by weight of silicate and 10% by weight of linear alkylbenzenesulfonate). In model washing tests following the general procedure "Washing tests", the formation of inorganic incrustations was investigated. The mean value of the ash values for all five fabrics is 2.2%.

TABLE 2

Composition of the test detergents

| | Ex. 6 | Ex. 7 | Ex. 8 | Ex. 9 |
|---|---|---|---|---|
| Zeolite A | 0 | 0 | 10.7 | 10.7 |
| SKS-6 | 13.8 | 21.3 | 3.1 | 0 |
| Compound | 27.4 | 20.8 | 27.4 | 30.4 |
| Polymer | 5 | 5 | 5 | 5 |
| Soda | 15.8 | 0 | 15.8 | 15.8 |
| Bicarbonate | 0 | 15 | 0 | 0 |
| Percarbonate | 18 | 0 | 0 | 0 |
| Perborate monohydrate | 0 | 0 | 18 | 18 |
| Perborate tetrahydrate | 0 | 0 | 0 | 0 |
| TAED | 5 | 0 | 5 | 5 |
| Linear alkylbenzenesulfonate | 0 | 0 | 0 | 0 |
| Nonionics | 8 | 10 | 8 | 8 |
| Soap | 2 | 1.5 | 2 | 2 |
| Antifoam | 1 | 0.5 | 1 | 1 |
| Enzyme I | 1.5 | 1 | 1.5 | 1.5 |
| Enzyme II | 1.5 | 1 | 1.5 | 1.5 |
| Optical brightener I | 0.25 | 0 | 0.25 | 0.25 |
| Optical brightener II | 0.25 | 0 | 0.25 | 0.25 |
| Phosphonate | 0.5 | 0 | .5 | 0.5 |
| Sodium citrate | 0 | 2 | 0 | 0 |
| Polyvinylpyrrolidone | 0 | 1 | 0 | 0 |
| Soil release polymer | 0 | 1 | 0 | 0 |
| CMC | 0 | 1 | 0 | 0 |
| Sulfate | Remainder | Remainder | Remainder | Remainder |
| Amount [g/wash] | 65 | 65 | 65 | 130 |
| Ash [%] | 1.7 | 1.9 | 1.9 | 2.2 |

Substances used

| | |
|---|---|
| Zeolite A: | Wessalith P, Degussa |
| SKS-6: | Phyllosilicate SKS-6 powder, Clariant |
| Polymer: | Sokalan CP5, BASF |
| Soda: | Heavy soda, Matthes & Weber |
| Bicarbonate: | Solvay |
| Percarbonate: | Oxyper C, Solvay Interox |
| Perborate monohydrate: | Degussa |
| Perborate tetrahydrate: | Degussa |
| TAED: | TAED 4049, Clariant |
| Linear alkylbenzenesulfonate | Marlon A 375, Hüls |
| Nonionics: | Genapol OAA 080, Clariant |
| Soap: | Liga soap base HM11E |
| Antifoam: | 11.powder.ASP3, Wacker |
| Enzyme I: | Termamyl 60T, Solvay Enzymes |
| Enzyme II: | Savinase 6.0 TW, Solvay Enzymes |
| Optical brightener I: | Tinopal CBS-X, Ciba |
| Optical brightener II: | Tinopal DMS-X, Ciba |
| Phosphonate: | Dequest 2041, Monsanto |
| Sodium citrate: | from Fluka |
| Polyvinylpyrrolidone: | Sokalan HP50, BASF |
| Soil release polymer: | SRC 1, Clariant |
| CMC: | Tylose 2000, Clariant |
| Sulfate: | Light sulfate, Solvay |

We claim:

1. A process for preparing a granular surfactant composition of sodium silicate and other constituents, wherein the granular surfactant composition comprises from 20 to 95% by weight of sodium silicate and from 5 to 80% by weight of at least one linear alkylbenzenesulfonate and wherein the granular surfactant composition has a mean particle diameter of $\geqq 50\ \mu m$ and a $ff_c$ value of $\geqq 7$, the process comprising mixing a finely divided crystalline sodium disilicate having a particle diameter $d_{90}$ of $\leqq 150\ \mu m$ with an aqueous solution of at least one linear alkylbenzene sulfonate to form a mixture and drying the mixture with a dryer aiding agglomeration to produce a granular material as a result of suitable agitation of the material, with the proviso that for the mixing, no energy intensive mixer imparting from about $1\times10^{11}$ to about $2\times10^{12}$ erg/kg of energy to said mixture at a rate of from about $1\times10^{9}$ to about $3\times10^{9}$ erg/kg·s is used.

2. The process as claimed in claim 1, wherein the granular surfactant composition comprises from 60 to 80% by weight of sodium silicate and from 20 to 40% by weight of at least one linear alkylbenzenesulfonate.

3. The process as claimed in claim 1, wherein the granular surfactant composition has a mean particle diameter of $\geqq 150\ \mu m$.

4. The process as claimed in claim 3, wherein the granular surfactant composition has a mean particle diameter of $\geqq 300\ \mu m$.

5. The process as claimed in claim 1, wherein the granular surfactant composition has a $ff_c$ value of $\geqq 10$.

6. The process as claimed in claim 1, wherein the finely divided crystalline sodium disilicate has a particle diameter $d_{90}$ of $\leqq 100\ \mu m$.

7. The process as claimed in claim 6, wherein the finely divided crystalline sodium disilicate has a particle diameter $d_{90}$ of $\leqq 50\ \mu m$.

8. The process as claimed in claim 1, wherein the dryer is a fluidized-bed dryer, a turbo flotation dryer or a rotary dryer.

9. The process as claimed in claim 8, wherein the fluidized-bed dryer has an incoming air temperature of 120–180° C. and a product temperature of about 60° C.

10. A process for preparing a detergent or cleaner comprising combining 1 to 80% by weight of zeolite and from 1 to 80% by weight of the granular surfactant composition prepared by the process of claim 1, wherein t he granular surfactant composition comprises 60 to 80% by weight of sodium silicate and 20 to 40% by weight of at least one linear alkylbenzene sulfonate and wherein t he granular surfactant composition has a mean particle diameter of $\geqq 50\ \mu m$ and a $ff_c$ value of $\geqq 7$.

11. A process for preparing a detergent or cleaner comprising combining 1 to 80% by weight of zeolite, from 1 to 80% by weight of crystalline sodium phyllosilicate and from 1 to 80% by weight of the granular surfactant composition prepared by the process of claim 1, wherein the granular surfactant composition comprises 60 to 80% by weight of sodium silicate and 20 to 40% by weight of at least one linear alkylbenzene sulfonate and wherein the granular surfactant composition has a mean particle diameter of $\geqq 50\ \mu m$ and a $ff_c$ value of $\geqq 7$.

* * * * *